US005142703A

United States Patent [19]

Basinger et al.

[11] Patent Number: 5,142,703

[45] Date of Patent: Sep. 1, 1992

[54] NECKWEAR HAVING FABRIC LINING WITH AREAS OF DIFFERENT FABRIC CONSTRUCTION

[75] Inventors: Lex L. Basinger, Concord; Jeffery L. Rachel, Siler City; Jerry E. Snider, Albemarle, all of N.C.; Allan S. Lerner, New York, N.Y.

[73] Assignee: Collins & Aikman Corporation, New York, N.Y.

[21] Appl. No.: 707,833

[22] Filed: May 30, 1991

[51] Int. Cl.[5] ..... A41D 25/00

[52] U.S. Cl. ..... 2/144; 2/146; 2/272; 2/149; 2/150

[58] Field of Search ..... 2/144, 146, 272, 149, 2/150; 66/169 R, 170, 171

[56] References Cited

U.S. PATENT DOCUMENTS

| | | | |
|---|---|---|---|
| Re. 30,950 | 6/1982 | Ackerman | 2/144 |
| 1,061,764 | 5/1913 | Marcus | 2/144 |
| 1,062,143 | 5/1913 | Cardot | 2/144 |
| 1,186,612 | 6/1916 | Satinover | 2/144 |
| 1,593,299 | 7/1926 | Goldberg | 2/146 |
| 1,756,901 | 4/1930 | Moore | 2/144 |
| 1,792,453 | 2/1931 | Thomas . | |
| 1,809,594 | 6/1931 | McCurrach | 2/144 |
| 1,827,313 | 10/1931 | Friedman | 2/144 |
| 2,126,835 | 8/1938 | Steinberger | 2/146 |
| 2,204,094 | 6/1940 | Meier | 130/413 |
| 2,311,460 | 2/1943 | Naftali | 2/146 |
| 2,800,661 | 7/1957 | Bergheim | 2/144 |
| 3,426,360 | 2/1969 | Ackerman | 2/146 |
| 3,562,814 | 2/1971 | Ackerman | 2/146 |
| 3,824,627 | 7/1974 | Schon | 2/146 |
| 4,123,802 | 11/1978 | Ackerman | 2/144 |
| 4,229,834 | 10/1980 | Alexander et al. | 2/146 |
| 4,506,389 | 3/1985 | Franklin | 2/146 |
| 5,044,013 | 9/1991 | Ackerman | 2/146 |

*Primary Examiner*—Werner H. Schroeder
*Assistant Examiner*—Gloria Hale
*Attorney, Agent, or Firm*—Bell, Seltzer, Park & Gibson

[57] ABSTRACT

A neckwear is disclosed which includes an outer fabric casing. A one-piece, multi-dimensional lining is carried within the casing and lies substantially coextensive with the casing along the length thereof. The lining is formed of a one-piece textile fabric cut substantially along the bias. The central neckband and knotting portion of the lining is characterized by having a different fabric construction than the fabric construction of the end portions of the lining to provide a finished neckwear product having a neckband and knotting area with the desired performance and tying characteristics. The neckwear also may include a plurality of linings positioned within the casing and a least one of the plurality of linings includes a central neckband and knotting portion having a different fabric construction than the fabric construction of the end portions of the lining.

19 Claims, 6 Drawing Sheets

NECKWEAR HAVING FABRIC LINING WITH AREAS OF DIFFERENT FABRIC CONSTRUCTION

FIELD OF THE INVENTION

This invention relates to neckwear having at least one fabric lining with different areas of fabric construction.

BACKGROUND OF THE INVENTION

Neckwear typically includes an inner fabric lining or linings contained within the outer casing of the neckwear. This inner fabric lining provides strength and support to the neckwear and should be constructed to resist wrinkling and creasing at least in the neckband and knotting area where the greatest resiliency and strength are needed. Neckwear also is constructed to follow fashion trends which currently are directed toward neckwear designs having lighter outer casings and inner linings. As a result, there is a greater need to construct an inner lining which not only provides strength, shape and support relative to the overall fashioned design of the neckwear, but also provides the desired performance in the neckband and knotting area.

Prior art neckwear generally has been constructed with one of three different types of linings. In the first, a one-piece lining extends the length of the neckwear. In the second, a two-piece lining consisting of two separate lining fabrics, or a double one lining overlapped or sewn together, extends through the casing. The additional lining adds strength to the neckwear, but it does not change the performance in the neckband and knotting area relative to the end portions. In the third, a second lining piece in the form of a tape, fabric or other material is superimposed onto the portion of the base piece of lining lying coextensive with the neckband and knotting area of the neckwear outer casing. The desired weight, hand, resiliency, and knotting characteristics of the neckwear in the neckband and knotting area are obtained by the choice of the second lining piece.

Although this construction provides for neckwear having the desired characteristics in the neckband and knotting area, the use of a separate lining piece superimposed on the base lining requires the additional manufacturing steps of cutting the separate lining piece or superimposing the separate piece on top of the base piece of lining so that the neckwear outer casing secures the base lining and the separate piece together. This additional manufacturing step not only is expensive, but also it is time-consuming and can create a bulky tie.

One prior art proposal, U.S. Pat. No. 1,809,594 to McCurrach, discloses lining-free neckwear in which the central portion corresponding to the neckband and knotting area is formed of two-mesh material with a double-weave construction. That portion is formed by cutting a fabric having single-ply end portions and a double-ply central portion along the bias so that the modified portion of the neckwear is positioned in the central portion of the neckwear. The McCurrach proposal is not desired because 1) the visible portion of the neckwear in the neckband and knotting area is modified and may appear structurally different from the end portions of the neckwear, and 2) a lining is not included.

SUMMARY OF THE INVENTION

It is therefore an object of the present invention to provide neckwear having an inner lining wherein the central neckband and knotting portion of the lining is constructed to provide neckwear having a desired performance and tying characteristics.

It is another object of the present invention to provide neckwear having an inner lining formed from a one-piece textile fabric in which the central neckband and knotting portion of the lining is constructed to have different fabric characteristics than the fabric characteristics of the end portions of the lining.

It is another object of the present invention to provide neckwear having a plurality of lining fabrics positioned within said casing, and wherein at least one of said lining fabrics comprises a one-piece, multi-dimensional lining having opposing end portions and a central neckband and knotting portion positioned between the end portions and wherein the central portion of the lining has a different fabric construction than the end portions of the lining.

It is another object of the present invention to provide a one-piece, multi-dimensional neckwear lining adapted to be positioned within an outer fabric casing of neckwear and in which the central neckband and knotting portion of the lining is characterized by having a different fabric construction than the fabric construction of the end portions of the lining.

In accordance with the present invention, the improved neckwear includes an outer fabric casing. A lining is carried within the casing and is substantially coextensive with the casing along the length thereof. In one embodiment, the lining is formed of a one-piece textile fabric cut along the bias. The central neckband and knotting portion of the lining is characterized by having a different fabric construction than the fabric construction of the lining portion lying coextensive with the end portions of the casing to provide a finished neckwear product having a neckband and knotting area with the desired performance and tying characteristics. Alternatively, a plurality of lining fabrics are positioned within the casing, and at least one of the lining fabrics comprises a one-piece, multi-dimensional lining fabric having opposing end portions and having a central neckband and knotting portion positioned between the end portions and wherein the central portion has different fabric construction than the end portions.

In one embodiment, the central neckband and knotting portion of the lining is formed of a textile material having a different yarn count than the yarn count in the end portions of the lining. Additionally, the lining may be formed of a textile material having either a plurality of open-end spun, ring-spun, filament or fibers formed of any other fiber forming technology.

The lining also may be formed of woven textile fabric having a greater number of yarn ends per inch in the central neckband and knotting portion of the lining than the number of yarn ends per inch in the end portions, or the central portion of the lining may have a different fiber blend combination than the fiber blend combination of the end portions.

In another embodiment, the lining is formed of a woven fabric and the central portion of the lining is formed of a double woven fabric while the end portions of the lining are formed of a single woven fabric. Alternatively, the end portions of the lining may be formed of a double woven fabric and the central portion of the lining may be formed of a single woven fabric.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
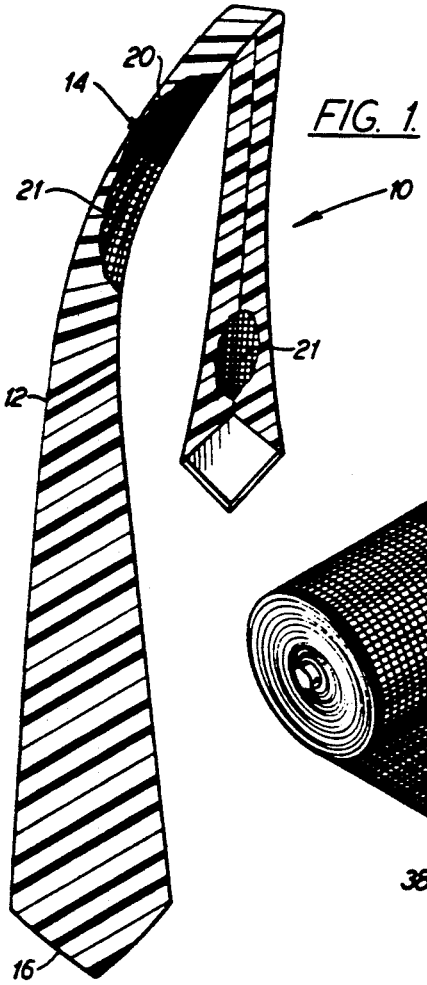
FIG. 1 is an isometric view of an article of neckwear in accordance with the present invention and showing the inner lining partially exposed.

Referring now to FIG. 1, there is illustrated the improved neckwear at 10 in accordance with the present invention. The improved neckwear 10 includes an outer fabric casing 12 manufactured in accordance with conventional techniques in which the casing 12 is woven from silk or any blend of conventional fibers and then cut along the bias.

The lining 14, illustrated partially in the broken section of the casing of FIG. 1, is initially positioned flat on the casing during the manufacture of the neckwear 10. The casing is then wrapped and sewn around the lining 14. In another manufacturing technique, the lining 14 may be inserted within the completed tube forming the casing.

The casing 12 is uniform throughout. The neckband and knotting area of the neckwear 10 could be heavier or lighter, but it always should be stronger and preferably more resilient because it takes much of the wear-and-tear of the neckwear during use.

As noted before, some neckwear manufacturers add strength to the lining 14 in the central neckband and knotting portion of lining 14 by adding a second piece to the area. Other proposals have changed the actual casing to make that part of the casing stronger or more flexible. Adding a separate piece to the lining in the central neckband and knotting area requires an additional manufacturing step. It also is expensive and time-consuming.

Changing the casing 12 in the neckband and knotting area is undesirable because the casing should remain a one-dimensional outer material in which the weight and hand of the material forming the outer casing is similar in the end portions and neckband and knotting area to give a similar appearance and hand throughout the neckwear.

Accordingly, if the performance in the neckband and knotting area of the neckwear 10 is to be enhanced as desired, the central neckband and knotting portion of the lining 14 must be improved and have a different fabric construction than the fabric construction of the end portions of the lining. Not only will this described lining structure provide an enhanced, economical one-piece lining, but also it will provide a final neckwear product of enhanced performance in the critical neckband and knotting area.

In accordance with the present invention, a neckwear lining is illustrated in FIG. 1 and shows a one-piece, multi-dimensional textile fabric cut along the bias. The term "dimension" refers to the fabric construction as imparting a desired hand and weight to the fabric. Thus, multidimensional connotates that the fabric lining construction in the central portion has a different dimension of weight and hand from the fabric construction at the end portions. Typically, the different fabric constructions between the center portion and the end portions will impart the different hand and weight. The different fabric construction techniques may include changing the yarn count in predetermined areas, changing the number of yarn ends per inch, changing the weave construction, for example to form a double or single cloth, changing the type or blend of yarn, or any combination of the above. As illustrated, the central neckband and knotting portion 20 of the lining is positioned within the casing and is characterized by having different fabric construction than the fabric construction of the end portions 21 of the lining to provide a final neckwear having a neckband and knotting area with the desired performance and tying characteristics.

Although the illustrated embodiment of FIG. 1 shows a single-piece, multi-dimensional fabric lining, the invention is not limited to a single, textile fabric lining positioned within the casing. The lining may also include two fabric lining pieces, and at least one of the lining pieces comprises a single-piece, multi-dimensional fabric lining as described above. Preferably, the two pieces should be held together by double weave construction. As many fabric lining pieces as desired may be included within the casing as long as at least one of the fabric pieces includes a fabric lining as described above and which imparts to the final neckwear product the desired performance and tying characteristics.

For example, some fashion styles dictate a small knot. Thus, the central neckband and knotting portion 20 of the lining 14 must be strong, yet thinner than the balance of the end portions of the lining. The different fabric construction between the central portion 20 of the lining and the end portions 21 allows construction of a neckwear product in which the neckband and knotting area of the neckwear has a different performance than the neckwear end portions.

The hand of the lining is sometimes generally defined as the character or individuality of the fabric when the fabric is handled and held within the hand. Many factors give character or individuality to a material observed through handling. An objective, analytical judgment can be made of a fabric material concerning its capabilities and content, working properties, drapability, feel, elasticity, fineness and softness, launderability, and other standards.

Some of the physical properties as evaluated by the American Society for Testing of Materials includes the following: the compressibility of the fabric and the ease in which it can be squeezed; the density or weight of the fabric per unit volume; the extensibility or ease in which the fabric may be stretched; the flexibility or ease in which the fabric can be bent; the resilience or ability of the fabric to recover from deformation; the surface contour or the divergence of the surface of the fabric from a plane; the surface friction or the resistance of the fabric from slipping; and the thermal character of the fabric. The weight of the fabric also can be measured in different standards including the weight of cloth in ounces per yard, the yards to the pound, or the ounces per square yard.

Figure 3:
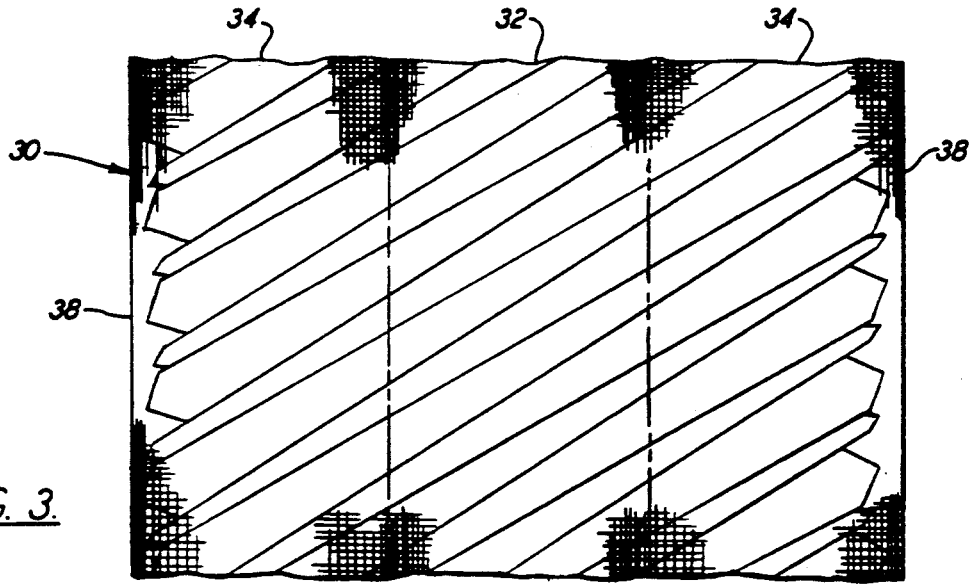
FIG. 3 is a plan view of a woven fabric in accordance with the present invention before the fabric is cut along the bias to form the neckwear lining which is inserted later within the outer casing.

The improved lining preferably is formed by cutting a modified woven fabric 30 along the bias (FIG. 3). The Woven fabric 30 includes a modified central panel 32 having different fabric construction than the fabric construction of the end portions 34. The fabric construction of the central panel 32 is woven into the panel 32 and corresponds to the desired fabric construction of the central portion 20 of the completed, cut lining. A 45 degree bias angle of cut is illustrated. The cuts also can be made substantially along the bias at differing angles less than or greater than the preferred 45 degree angle if a different angle than the preferred 45 degree bias angle provides the desired fabric construction for the end product. However, the 45 degree angle bias cut is preferred because a fabric cut along the bias normally has greater strength, wear properties and resists twisting as compared to fabrics cut along a different angle.

Figure 2:
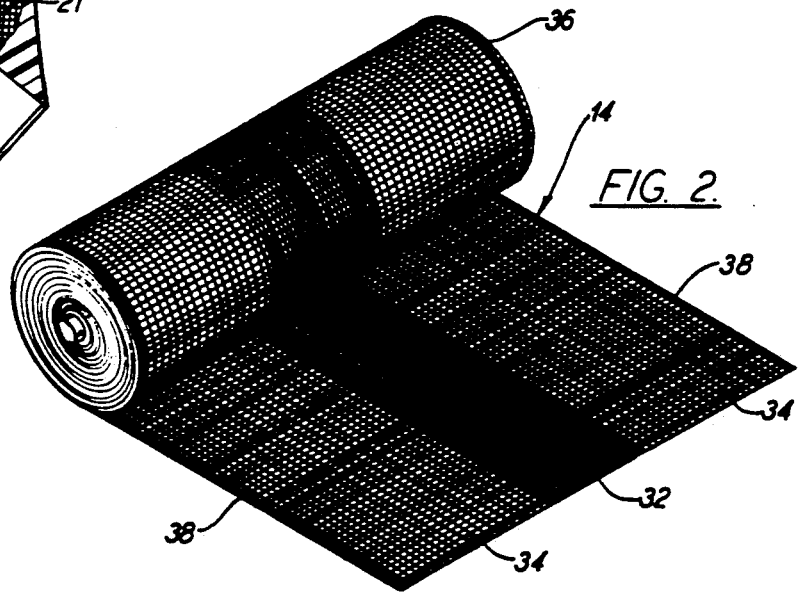
FIG. 2 is an isometric view of a woven fabric in accordance with the present invention and which is convolutely wound in roll form.

As shown in FIG. 3, the improved lining fabric 14 is cut from a modified textile fabric piece which preferably is woven, although it is also possible to produce the modified textile piece from a fabric which is knit on a flat bed knitting machine. Typically, the lining 14 is woven and convolutely wound as a roll 36 on a loom take-up beam (FIG. 2). The convolutely wound roll 36 then is processed further or shipped to a secondary processor which produces neckwear in accordance with its own requirements and marketing demands.

Once the linings 14 are woven, they are out typically in a two cavity die along the bias from one salvage 38 to one salvage 38. Fabric also can be cut with a round knife. Thus, the final length of a lining encased in the outer casing 12 depends on the chosen width of the woven fabric. For example, one example of a modified woven lining fabric is 38 inches wide and cut on a 45 degree angle from salvage to salvage to yield a 53.74 inch lining which when inserted within the casing yields a finished tie approximately 55 inches long. Although neckwear dimensions vary depending on the fashion style, consumer tastes, and marketing demands, one example of a neckwear style has a neckband and knotting area approximately 22 inches in the center of a 55 inch long neckwear outer casing. Thus, a final woven product emerging from the loom in which the central neckband and knotting area is approximately 16 inches wide and positioned in the center of a 38 inch finished lining fabric will produce the desired lining.

Although the process has been described relative to weaving neckwear lining, in certain cases, the modified lining fabric can be produced on a flat bed knitting machine. However, the various embodiments of the improved lining will be described relative to forming the lining from a woven fabric.

Figure 4:
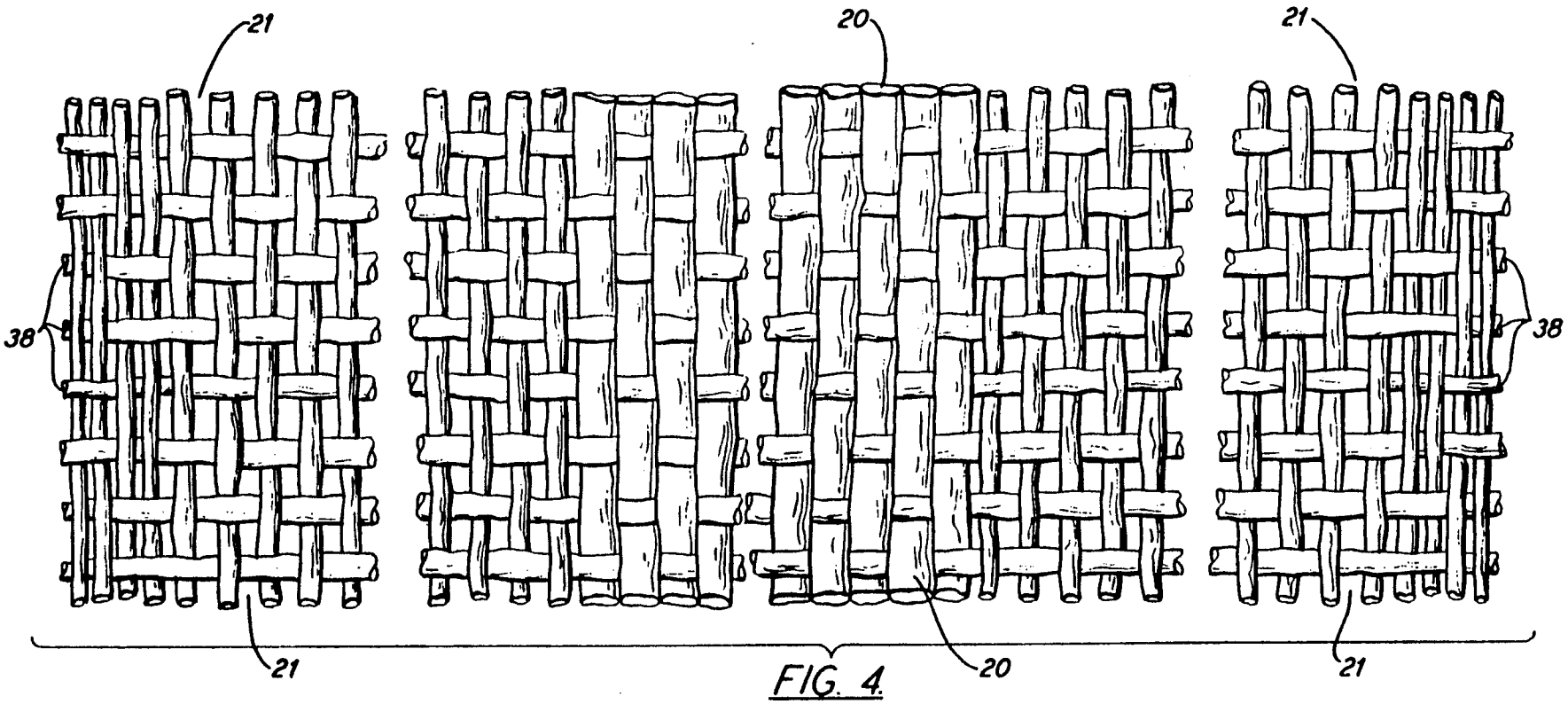
FIG. 4 is an enlarged, fragmentary plan view of one embodiment of the lining in which the yarn count varies between the central and end portions of the lining.

FIG. 4 illustrates one embodiment of the lining 14 in which the central portion 20 of the lining is formed of a textile material having a different yarn count than the yarn count in the end portions 21 of the lining.

In the illustrated embodiment, the yarn count is greater in the central portion 20. The larger yarns, as seen in the warp direction, will provide a heavier lining in the central portion, adding strength and recoverability to this critical area of the final neckwear product. If a smaller knot is desired when tying the neckwear, the yarn count can be made smaller in the central portion leading toward the end portions. The yarns positioned in the central portion 20, even though having a smaller count for allowing the tying of smaller than normal knots, can be chosen to provide a stronger and more resilient lining in the central portion. For example, smaller count wool-blend yarns can be placed in the central portion as compared to polyester or other yarns which are positioned in the end portions 16. Wool-blend yarns will provide better stability even though the central portion of the lining positioned in the neckband and knotting area is thinner and will result in a tighter knot.

The count also can vary in the central portion so that a gradual yarn count transition occurs from the central portion 20 of the lining to the end portions 21. The yarn count also can differ between various yarns positioned in the central portion of the lining. The yarn count may gradually increase or decrease toward the end portions 21 resulting in a multi-dimensional lining. For example, the central portion 20 can be divided into a number of sections in which the yarn count varies to aid in the gradual increase or decrease in yarn count toward the end portions. The lining 14 also may be formed of a textile material formed from a plurality of open-end spun fibers, ring-spun fibers, filament fibers or fibers produced by any yarn manufacturing technology.

Additionally, the lining 14 may be formed from a plurality of different fiber blend combinations. The central different fiber blend combination than the fiber blend combination of the end portions 21, thus changing the fabric construction of the central portion of the lining from the fabric characteristics of the end portions. For example, adding the more expensive and resilient wool to the normal polyester lining in the central portion not only imparts better recovery to the central portion 20, but also adds strength to the most critical area of the lining. Cotton, acrylic, viscose and many other types of fibers also may be added in various blend combinations to create a lining 14 and finished neckwear 10 having the desired fabric characteristics. Blending the different fibers to impart greater recovery to the central portion of the lining is important because the neckband and knotting area receives the most wear-and-tear. Additionally, the liner may have microfibers included in the blend of fibers.

Figure 5:
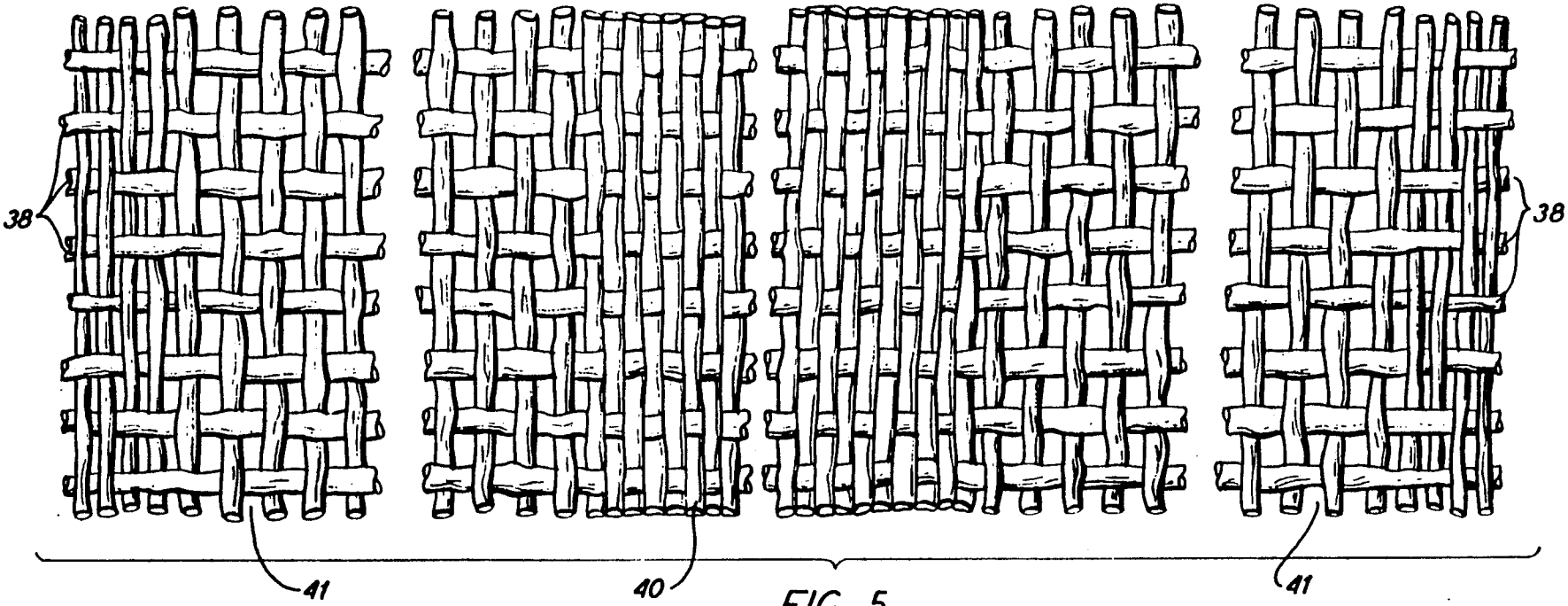
FIG. 5 is an enlarged, fragmentary plan view of another embodiment of the lining in which the central portion has a greater number of yarn ends per inch than the end portions.

Referring now to FIG. 5, there is illustrated another embodiment of the improved lining in accordance with the present invention in which the central portion 40 of the lining has a different number of yarn ends per inch than the number of yarn ends per inch in the end portions 41.

In the illustrated embodiment of FIG. 5, more yarn ends per inch in the central portion 40 are illustrated. This produces a more dense fabric in the central portion 40 of the lining, imparting greater strength and durability to that critical portion of the lining most subject to wear-and-tear. In weaving the illustrated lining, more yarn ends are inserted through a dent in the reed to produce a thicker fabric at that particular area.

As illustrated, a constant number of yarn ends per inch are evenly spaced throughout the central portion 40 of the lining. Instead of evenly spaced yarns in the central portion 40, the number of yarn ends per inch can vary across the central portion of the lining to produce a transition from the central portion 40 toward the end portions 41. For example, during weaving, the middle area of the central portion may be manufactured by inserting three or four yarn ends through a dent in the reed. Progressing toward the end portions while remaining still within the confines of the central portion 40 of the lining, two yarn ends are inserted through a dent in the reed. The outer end portions 41 may be manufactured by inserting a single yarn end through a dent in the reed. This type of yarn transition may vary and the central portion 40 may include a lesser number of ends per inch than the end portion to form a thinner section in this critical area of the lining.

To counter the expected weakness of a thinner central portion 32, the fibers in the central portion 40 of the lining may be formed predominantly of a yarn material which is stronger and more resilient than yarn materials used in the end portions of the lining. Using yarns produced from predominantly wool would be sufficient. The selection of other yarns is a choice which depends on the type of properties desired in the final neckwear product.

Figure 6:
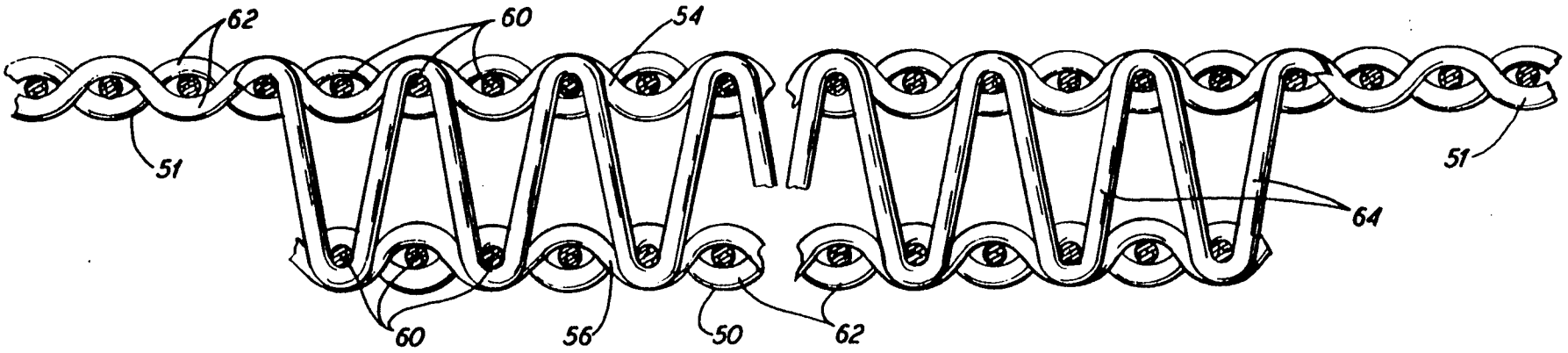
FIG. 6 is an enlarged, fragmentary sectional view of another embodiment of the lining in which the central portion of the lining is formed of a double woven fabric.

Another embodiment of the lining in accordance with the present invention is illustrated in FIG. 6 in which the central portion 50 of the lining is formed of a single-piece, double woven fabric while the lining end portions 51 are formed of single woven fabric. Alternatively, as shown in FIG. 7, the central portion of the lining is formed of single woven fabric and the end portions are formed of a double woven fabric.

Figure 7:
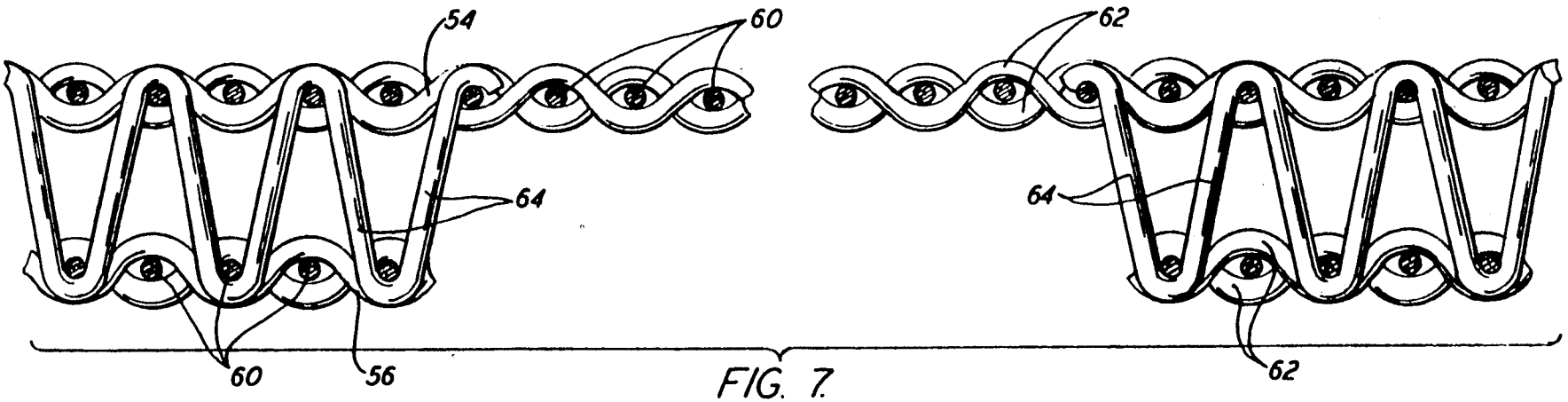
FIG. 7 is an enlarged, fragmentary sectional view of another embodiment of the lining in which the end portions of the lining are formed of a double woven fabric.

As shown in the enlarged sectional views of FIG. 6 and 7, the double fabric portions of the fabric consists of two woven fabric plys 54, 56 consisting of warp yarns 60 and filler 62 yarns. The first fabric ply 54 and the second fabric ply 56 are positioned one above the other with the warp yarns and filler yarns of the first ply extending in the same direction as the corresponding yarns of the second lining.

The lining is provided with several pluralities of binder yarns 64 which may be woven together with the first and second plys 54 and 56 on a cam loom as is conventional in the art. Production on a conventional dobby loom also is possible. Alternatively, a jacquard loom may be used and the filling yarns interlaced on a controlled plan to provide a balanced, non-torqued product.

In the illustrated embodiment, each binder yarn 64 alternatively engages each of the first and second fabric plys 54, 56 in stressed condition, forming a highly resilient single interwoven double cloth fabric. U.S. Pat. No. 4,229,834, assigned to the present assignee, illustrates and describes in detail one method which can be used to manufacture the double cloth in accordance with the present invention.

In addition to the details described in that patent, the lining in the illustrated embodiment can be fabricated of wool, polyester, wool blends, polyester blends of spun or filament polyester, viscose, acetate, acrylic and spun natural or synthetic fibers. The plain woven fabric in the embodiment may include fancy weaves and may include satins, drills, twills and other weaves.

Figure 8:
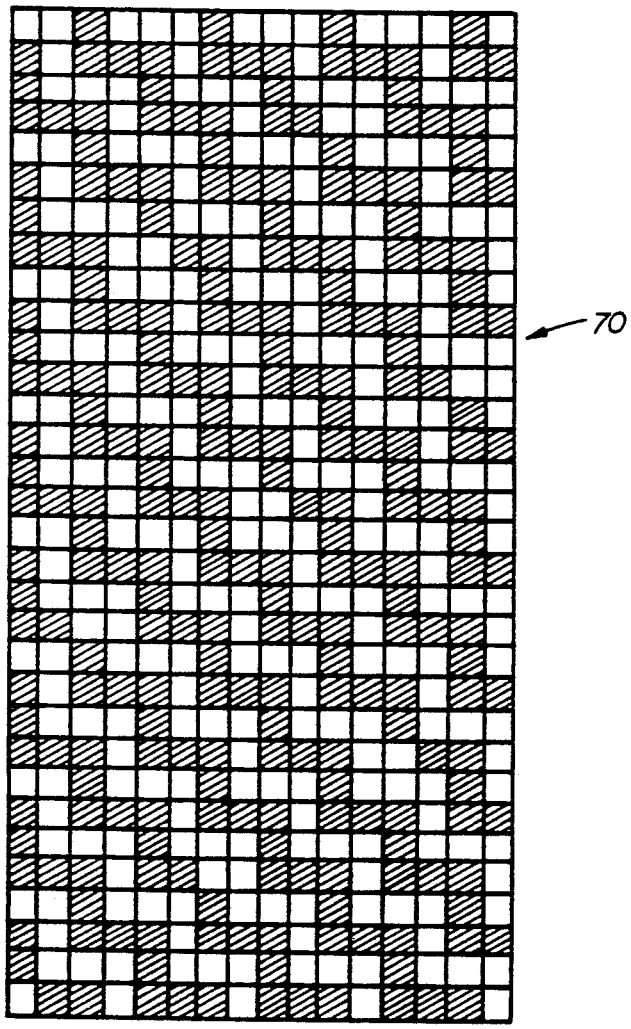
FIG. 8 is a point diagram illustrating the weave construction for forming a double fabric in accordance with the present invention.

Referring now to FIG. 8, a point diagram is shown generally at 70. The particular weave construction illustrated in the point diagram shows one construction which allows construction of the double fabric embodiment as described. This particular weave construction allows not only warp ends but filling picks to transcend the two levels and bind the two layers of cloth without the introduction of a specific binder warp. This can be woven on a single beam set-up.

The present invention has several benefits over other prior art neckwear and linings. The present invention provides a one-piece neckwear lining 14 which is multidimensional throughout the length of the lining. The manufacturing steps used in making a one-piece, multidimensional lining 14 are more efficient and reduce the material handling, cutting and manufacturing time as compared to the manufacturing of other prior art linings in which greater material handling, cutting and manufacturing time occurs.

By appropriate selection of the fabric construction in the central neckband and knotting portion 20 of the lining, a desired strength and resiliency can be added to the finished neckwear while maintaining shape and supple lightness in the visual and tactile end-blade areas of the neckwear. The size of the knotting area also can be influenced by the choice of lining. Longitudinal stability is increased to limit stretching and thus maintain neckwear appearance over longer periods.

In the drawings and specification, there has been set forth preferred embodiments of the invention, and while there are specific terms employed, they are used in the generic and descriptive sense only and not for purposes of limitation.

What is claimed is:

1. A neckwear comprising an outer fabric casing, a one-piece, multi-dimensional lining having opposing end portions and having a central neckband and knotting portion positioned between said end portions, said lining being carried within said casing and lying substantially coextensive with said casing along the length thereof, said lining being formed of a one-piece textile fabric cut substantially along the bias and wherein the central portion of said lining is formed of a first type of fabric construction and the end portions of the lining are formed of a second type of fabric construction.

2. A neckwear according to claim 1 wherein the central portion of said lining is formed of a textile material having a first yarn count and the end portions of said lining having a second yarn count.

3. A neckwear according to claim 1 wherein said lining is formed of a woven textile fabric having a first number of yarn ends per inch in the central portion of said lining and a second number of yarn ends per inch in the end portions.

4. A neckwear according to claim 1 wherein said lining is formed of a plurality of fibers of different fiber blend combination and wherein the central portion of said lining is formed of a material having a first fiber blend combination and the end portions of the lining are formed of a material having a second fiber blend combination.

5. A neckwear according to claim 1 wherein said lining is formed of a woven fabric, and wherein the central portion of said lining is formed of a double woven fabric while said end portions of said lining are formed of a single woven fabric.

6. A neckwear according to claim 1 wherein said lining is formed of a woven fabric, and wherein the central portion of said lining is formed of a single woven fabric and said end portions of said lining is formed of a double woven fabric.

7. A neckwear comprising an outer fabric casing, a plurality of single-piece linings positioned within said casing, at least one of said single piece linings comprising a one-piece, multi-dimensional lining having opposing end portions and a central neckband and knotting area positioned between said end portions, said lining being carried within said casing and lying substantially coextensive with said casing along the length thereof, said lining being formed of a one-piece textile fabric cut substantially along the bias and wherein the central portion of said lining is formed of a first type of fabric construction and the end portions of the lining are formed of a second type of fabric construction.

8. A one-piece, multi-dimensional lining adapted to be positioned within an outer fabric casing of neckwear, said lining having opposing end portions and a central neckband and knotting area positioned between the end portions, said lining being formed of a one-piece, multi-dimensional textile fabric cut substantially along the bias and wherein the central neckband and knotting area of said lining is formed of a first type of fabric construction and the end portions of the lining are formed of a second type of fabric construction.

9. A neckwear lining according to claim 8 wherein the central portion of said lining is formed of a textile material having a first yarn count and the end portions of said lining are formed of a textile material having a second yarn count.

10. A neckwear lining according to claim 8 wherein said lining is formed of woven textile fabric having a first number of yarn ends per inch in the central portion of said lining and a second number of yarn ends per inch in the end portions.

11. A neckwear lining according to claim 8 wherein said neckwear lining is formed of a plurality of fibers of different fiber blend combination and wherein the central portion of said lining is formed of a material having a first fiber blend combination and the end portions of the lining are formed of a material having a second fiber blend combination.

12. A neckwear lining according to claim 8 wherein said lining is formed of a woven fabric, and wherein the central portion of said lining is formed of a single woven fabric while said end portions of said lining are formed of a double woven fabric.

13. A neckwear lining according to claim 8 wherein said lining is formed of a woven fabric, and wherein the central portion of said lining is formed of a double woven fabric while said end portions of said lining are formed of a single woven fabric.

14. A one-piece, multi-dimensional woven fabric convolutely wound in roll form and unrolled and cut substantially along the bias to form a neckwear lining, said woven fabric having opposing salvage edge portions and a central neckband and knotting portion positioned between the salvage edge portions, and wherein the central neckband and knotting portion of said lining is formed of a first type of fabric construction and the salvage end portions of the lining are formed of a second type of fabric construction.

15. A one-piece woven fabric according to claim 14 wherein the central portion of the woven fabric is formed of a textile material having a first yarn count and the salvage edge portions of the fabric having a second yarn count.

16. A one-piece woven fabric according to claim 14 wherein the fabric is formed of woven textile fabric having a first number of yarn ends per inch in the central portion and a second number of yarn ends per inch in the salvage edge portions.

17. A one-piece woven fabric according to claim 14 wherein the woven fabric is formed of a plurality of fibers of different fiber blend combination and wherein the central portion of the fabric is formed of a material having a first fiber blend combination and the end portions of the fabric are formed of a material having a second fiber blend combination.

18. A one-piece woven fabric according to claim 14 wherein the central portion of the fabric is formed of a single woven fabric while the edge portions of the fabric are formed of a double woven fabric.

19. A one-piece woven fabric according to claim 14 wherein the central portion of the fabric is formed of a double woven fabric while the salvage edge portions of the fabric are formed of a single woven fabric.

* * * * *